US006860461B1

(12) United States Patent
Otani et al.

(10) Patent No.: US 6,860,461 B1
(45) Date of Patent: Mar. 1, 2005

(54) MOLD FOR PAPERMAKING

(75) Inventors: Kenichi Otani, Tochigi (JP); Yoshiaki Kumamoto, Tochigi (JP); Tokuo Tsuura, Tochigi (JP); Minoru Goto, Tochigi (JP); Keiji Eto, Tochigi (JP)

(73) Assignee: Kao Corporation, Tokyo (JP)

( * ) Notice: Subject to any disclaimer, the term of this patent is extended or adjusted under 35 U.S.C. 154(b) by 14 days.

(21) Appl. No.: 09/926,690

(22) PCT Filed: May 30, 2000

(86) PCT No.: PCT/JP00/03475

§ 371 (c)(1),
(2), (4) Date: Dec. 3, 2001

(87) PCT Pub. No.: WO00/75428

PCT Pub. Date: Dec. 14, 2000

(30) Foreign Application Priority Data

Jun. 2, 1999 (JP) ..... 11-155642

(51) Int. Cl.[7] ..... D21J 7/00
(52) U.S. Cl. ..... 249/113; 425/405.1; 162/382
(58) Field of Search ..... 249/112, 288; 425/405.1, 412, 451.2, 186, 195; 162/228, 382, 396, 397, 411

(56) References Cited

U.S. PATENT DOCUMENTS 2,105,593 A * 1/1938 Hatton ..... 162/396
2,149,878 A * 3/1939 Mitchell ..... 162/228
2,471,932 A * 5/1949 Chaplin ..... 162/223
2,600,265 A * 6/1952 Randall ..... 249/113
2,961,043 A 11/1960 Hicks
4,014,739 A 3/1977 Granberg
4,853,087 A * 8/1989 Schlor et al. ..... 162/383
5,770,016 A * 6/1998 Greve ..... 162/396

FOREIGN PATENT DOCUMENTS

| | | |
|---|---|---|
| JP | 51-2577 | 1/1976 |
| JP | 61-28100 | 2/1986 |
| JP | 63-227900 | 9/1988 |
| JP | 79800/1994 | 11/1994 |
| JP | 9-188987 | 7/1997 |
| JP | 10-37100 | 2/1998 |

* cited by examiner

*Primary Examiner*—James P. Mackey
*Assistant Examiner*—Donald Heckenberg
(74) *Attorney, Agent, or Firm*—Oblon, Spivak, McClelland, Maier & Neustadt, P.C.

(57) ABSTRACT

A papermaking mold which includes a papermaking part of a prescribed shape, a peripheral part extending outward from the peripheral edge of the papermaking part, and a net covering the papermaking part and at least part of the peripheral part. A fixing member is disposed on the periphery of the net, and the fixing member is fixed to the peripheral part to fix the net by the fixing member.

3 Claims, 8 Drawing Sheets

10
10
31
30
32
33
30
32
33
30
32
33
30
32

101
101
120c
120a
120c
120a
120c
107
C
C
C
106
106
106
106

MOLD FOR PAPERMAKING

TECHNICAL FIELD

The present invention relates to a papermaking mold used to produce pulp molded articles.

BACKGROUND ART

A papermaking mold used to manufacture pulp molded articles usually has a net on the inner surface of its papermaking part. The net is generally fixed to the mold by welding or with metal wire, etc. Otherwise, the net would move out of a prescribed position during papermaking by the pressure or the flow of a pulp slurry injected, etc., which results in a failure to obtain a molded article of a desired shape or results in a non-uniform thickness of the resulting molded article.

As a mold with a net is used repeatedly for producing molded articles, pulp fiber is adhered and accumulated on the net to cause unevenness in thickness of molded articles or impair the appearance of molded articles. Thus, it is necessary for the net to be removed and cleaned. However, where the net is fixed by welding, it is not easy to remove the net. Where it is fixed with wire, etc., removal is possible but laborious.

In a conventional papermaking mold, a mold clamping force is applied to the peripheral part of the mold where the papermaking net is disposed so that the force is directly exerted on the net. As a result, the net is deformed on clamping and gradually damaged from repetition of papermaking and eventually needs an exchange. Where, in particular, a wet preform after papermaking and dewatering is transferred from the papermaking mold to a drying mold by purging with compressed air and suction, the frequency of mold opening and closure increases, and the part of the net which covers the peripheral part of the mold which extends outward from the papermaking part suffers considerable damage. This problem occurs in conjunction with the above-mentioned difficulty of net exchange where the net is fixed to the mold by welding or with wire, etc. Therefore a papermaking mold of which the net hardly suffers damage from repeated use of the mold has been desired.

Accordingly, an object of the present invention is to provide a papermaking mold the net of which can be attached and detached with improved ease.

Another object of the present invention is to provide a papermaking mold which reduces damage to the net thereof when used repeatedly.

DISCLOSURE OF THE INVENTION

The present invention accomplishes the above objects by providing a papermaking mold which comprises a papermaking part of a prescribed shape, a peripheral part extending outward from the peripheral edge of the papermaking part, and a net covering the papermaking part and at least part of the peripheral part, wherein a fixing member is disposed on the periphery of the net, and the fixing member is fixed to the peripheral part to fix the net by the fixing member.

The present invention also accomplishes the above objects by providing a papermaking mold which comprises a papermaking part of a prescribed shape, a peripheral part extending outward from the papermaking part, and a papermaking net covering the papermaking part and at least part of the peripheral part, wherein the part of the net which covers the peripheral part is disposed in the site where it does not receive a mold clamping force or it is not damaged by a mold clamping force.

BRIEF DESCRIPTION OF THE DRAWINGS

FIG. 3(*b*) schematically shows the step of inserting a pressing member. FIG. 3(*c*) schematically shows the step of pressing and dewatering. FIG. 3(*d*) schematically shows the step of removal from the mold.

FIG. 6(*b*) schematically shows the step of inserting a pressing member. FIG. 6(*c*) schematically shows the step of pressing and dewatering. FIG. 6(*d*) schematically shows the step of removal from the mold.

BEST MODE FOR CARRYING OUT THE INVENTION

The present invention will be described based on the preferred embodiments with reference to the accompanying drawings.

Figure 1:
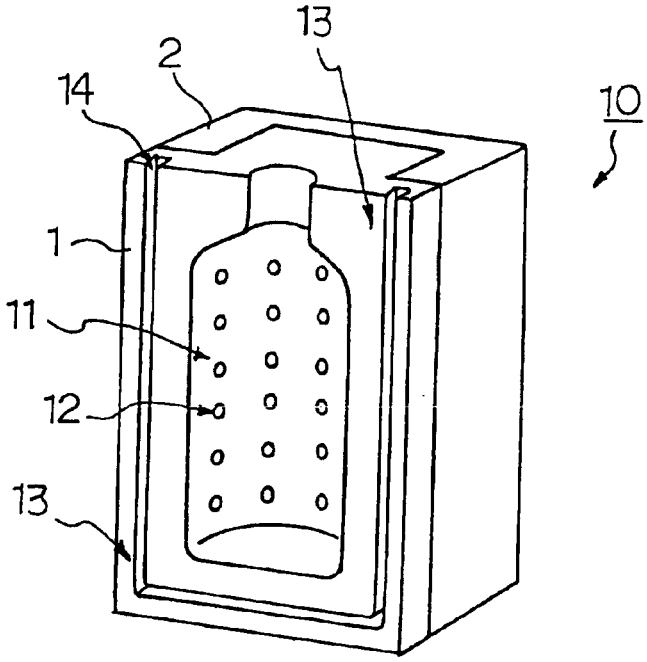
FIG. 1 is a perspective of a papermaking mold with no net disposed.
Figure 2:
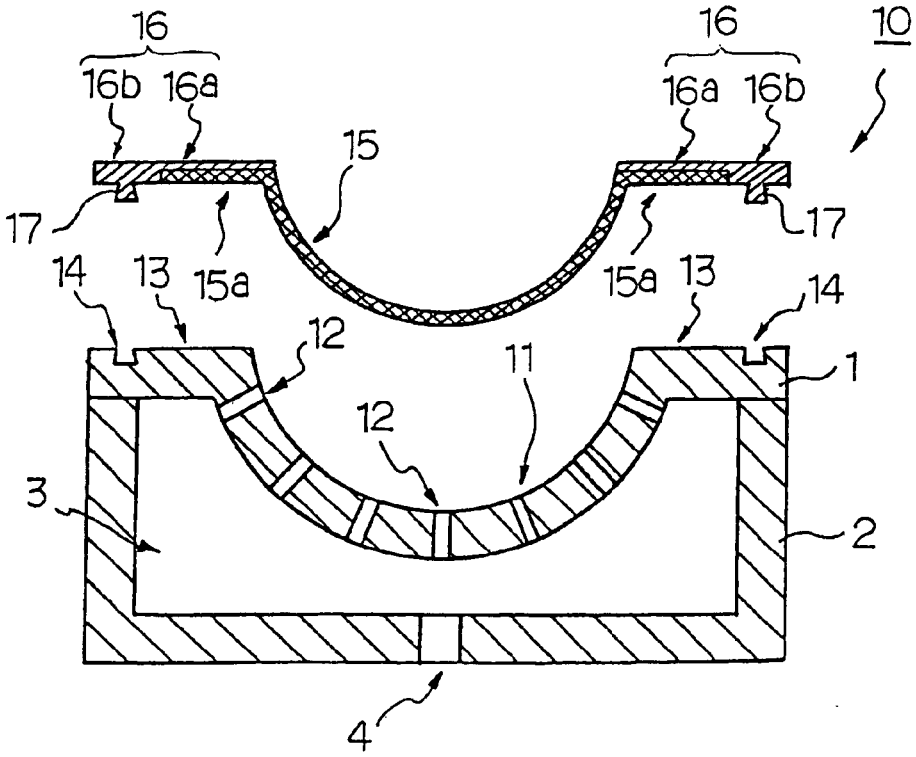
FIG. 2 is a cross-section of the papermaking mold shown in FIG. 1 and a net which is about to be attached thereto.

FIGS. 1 and 2 illustrate a first embodiment of the present invention. As shown in these figures, the papermaking mold 10 according to the first embodiment has a first member 1 and a second member 2. The first member 1 has a papermaking part 11. The papermaking part 11 has a concavity. The papermaking part 11 has a large number of through-holes 12 pierced therethrough to connect the surface and the reverse thereof. The peripheral edge of the papermaking part 11 extends outward horizontally to form a peripheral part 13. The edges of the peripheral part 13 form a rectangle in its plan view. A continuous groove 14 is made on the peripheral part 13 near and along the edges. The groove 14 is used as a depression mating with a projection 17 hereinafter described. The part of the peripheral part 13 near the papermaking part 11 and the whole papermaking part 11 are covered with a net 15.

The second member 2 has a box shape. When the first member 1 is fitted into the second member 2, there is formed a prescribed space 3 between the first member 1 and the second member 2. The second member 2 has a through-hole 4, which is connected to a prescribed suction means (not shown) in carrying out papermaking. Thus, the through-holes 12, the space 3, and the through-hole 4 connect with each other to form an interconnecting passage from the outside of the mold 10 to the inside of the papermaking part 11.

The net 15 is provided along the surface of the papermaking part 11 and the peripheral part 13. The net 15 is shaped in conformity to the contour of a vertical half of a molded article to be produced. The net 15 is made of wire of metal, synthetic resin, etc. The opening size is usually about 10 to 100 mesh (JIS L-0208). The net 15 may have a single layer structure, a knitted structure, or a composite structure composed of two or more net layers. A porous material having a large number of permeating pores which is formed by electroforming can be used as the net 15, in which case the diameter of the permeating pores is about 0.05 to 2 mm.

With the net 15 fitted on the first member 1, the net 15 and the surface of the papermaking part 11 may be in close contact with each other. It is preferred, however, that the net 15 covers the papermaking part 11 with a prescribed clearance for preventing clogging by pulp fibers during papermaking and for improving papermaking efficiency.

The papermaking mold 10 according to the present embodiment is used as paired with another half in such a manner that the papermaking parts 11 of the pair face each other so that the facing papermaking parts 11 form a cavity of a prescribed shape. A pulp slurry is injected into this cavity to deposit pulp fiber on the net. Accordingly, the pair to the papermaking mold 10, which is not illustrated, has the same structure.

The net 15 is provided with a fixing member 16 which covers the upper side of the part 15*a* of the net 15 that covers the peripheral part 13 (this part of the net 15 will hereinafter be referred to as a peripheral covering part) and also surrounds the edges of the net 15. That is, the fixing member 16 is composed of a first part 16*a* which covers the upper side of the peripheral covering part 15*a* and a second part 16*b* which adjoins and surrounds the edges of the net 15. The thickness of the second part 16*b* is equal to the sum of the thickness of the first part 16*a* and the thickness of the peripheral covering part 15*a*. The fixing part 16 is fixed onto the peripheral part 13 by a prescribed means whereby the net 15 is fixed by the fixing member 16. In this manner, there is no need to directly fix the net 15 itself, and the net 15 can be attached and detached with ease simply by fixing and removing the fixing member 16. In this embodiment, since the peripheral covering part 15*a* of the net 15 is entirely covered with the fixing member 16, the net 15 gains in strength and is thereby prevented from deformation and the like when attached or detached.

The fixing member 16 has, on its second part 16*b*, a projection 17 as a mating projection on its side facing the peripheral part 13. The projection 17 fits into the groove 14, a mating depression, whereby the fixing member 16 is fixed to the peripheral part 13.

The material composing the fixing member 16 is not particularly limited. As stated above, the papermaking mold 10 of the present embodiment is used as paired, and a pair of the molds 10 are mated such that the papermaking parts 11 face each other, i.e., the fixing members 16 are brought into contact with each other. Therefore it is preferred for ensuring tight contact that the fixing member 16 be capable of elastic deformation or plastic deformation. The fixing member 16 which is capable of elastic deformation is made of elastic materials, such as silicone rubber and epoxy resins, and the fixing member 16 which is capable of plastic deformation is made of metal or plastic materials, such as polyethylene and polypropylene.

The fixing member 16 may be either separate from or integral with the net 15. For strengthening the net 15, the fixing member 16 is preferably integral with the net 15. Where the fixing member 16 and the net 15 are integral with each other, it is preferred that the fixing member 16 be integrally fixed to the peripheral covering part 15*a*. The fixing member 16 which is made of such a material as silicone rubber, an epoxy resin, etc. and is integral with the peripheral covering part 15*a* is obtained by, for example, press-bonding the material to the peripheral covering part 15*a* or coating or impregnating the peripheral covering part 15*a* with the material. The fixing member 16 which is made of a metal and is integral with the peripheral covering part 15*a* is obtained by forming a prescribed metal shell on the peripheral covering part 15*a* by electroforming or a like method.

Figure 3:
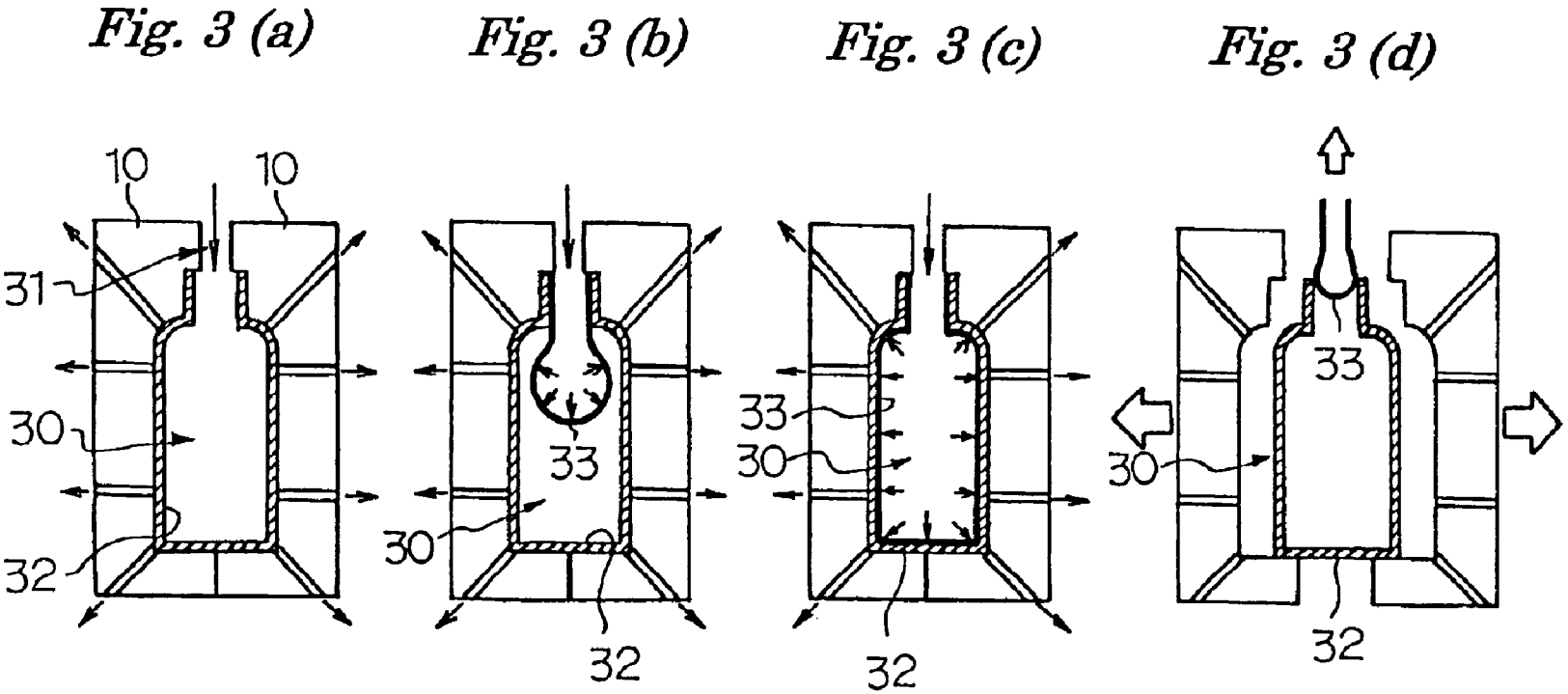
FIG. 3(*a*) schematically shows the step of injecting a pulp slurry followed by dewatering.

A pulp molded article is produced by the use of the papermaking mold of the present embodiment in accordance with the method shown in FIGS. 3(*a*) through (*d*). As shown in FIG. 3(*a*), a pair of molds 10 and 10 are mated together so that the papermaking parts 11 face each other to form a cavity 30 of a prescribed shape, which is contoured by the two papermaking parts 11. A pulp slurry is poured into the cavity 30 through an opening 31 connecting to the cavity 30. The molds 10 and 10 are sucked from their outside and the pressure in the cavity 30 is reduced. As a result, the water content of the pulp slurry is sucked up, and the pulp fiber is deposited on the net (not shown) to form a water-containing preform 32.

On completion of pouring a prescribed amount of the pulp slurry, pouring is stopped, and the cavity 30 is completely sucked for dewatering. An inflatable hollow pressing member 33 is inserted into the cavity 30 while continuing sucking and evacuating the cavity 30 as shown in FIG. 3(*b*). The pressing member 33 is made of an elastic material, such as urethane, fluororubber, silicone rubber or an elastomer, or a plastic material, such as polyethylene or polypropylene.

As shown in FIG. 3(*c*), a pressurizing fluid is fed into the pressing member 33 to inflate the pressing member 33. The inflated pressing member 33 presses the wet preform 32 onto the net. The preform 32 pressed to the net by the pressing member 33, pressing and dewatering of the preform 32 proceed while the inner shape of the net is transferred to the preform 32. The pressurizing fluid used to inflate the pressing member 33 includes compressed air (heated air), oil (heated oil), and other various liquids. The pressure for the pressurizing fluid feed is preferably 0.01 to 5 MPa, particularly 0.1 to 3 MPa.

After the preform 32 is pressed and dewatered to a prescribed water content, and after the inner shape of the cavity 30 is sufficiently transferred to the preform 32, the pressurizing fluid is withdrawn from the pressing member 33 to shrink the pressing member 33 as shown in FIG. 3(*d*).

The shrunken pressing member 33 is taken out of the cavity 30, and the molds are opened to remove the preform 32 having been pressed and dewatered to a prescribed water content. The removed preform 32 is subjected to a prescribed heat drying stage, where it is completely dried to give a pulp molded article.

Figure 4:
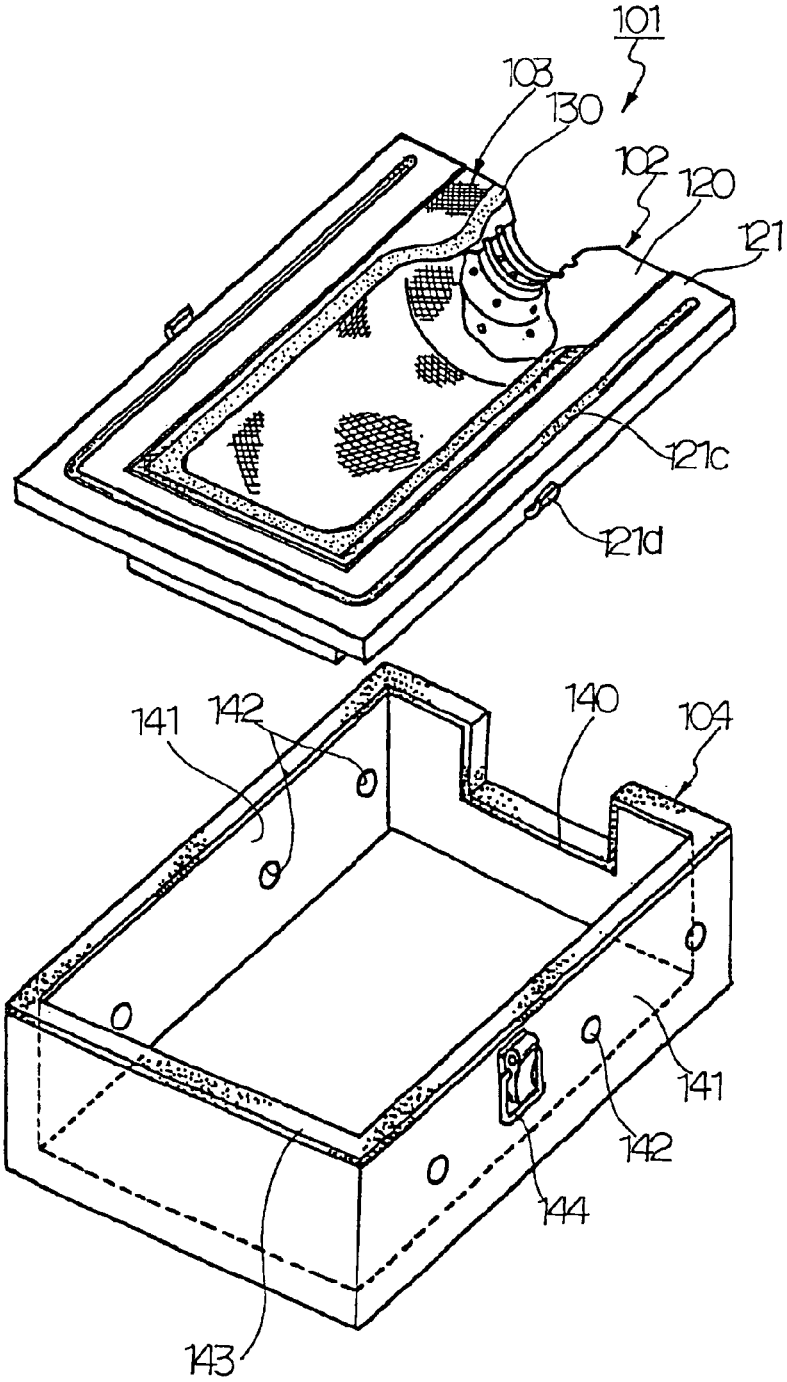
FIG. 4 is an exploded perspective of a papermaking mold according to a second embodiment of the present invention, which is used to produce pulp molded articles, with a part cut away.
Figure 5:
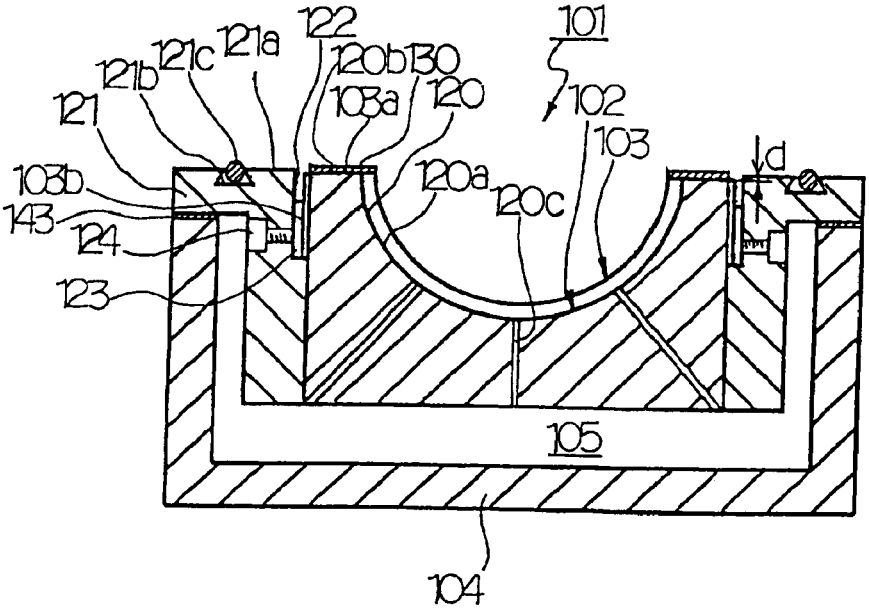
FIG. 5 schematically shows the cross-sectional structure of the papermaking mold.

FIGS. 4 and 5 show a second embodiment of the papermaking mold according to the present invention. In these figures, numerical reference 101 indicates a papermaking mold.

As illustrated in FIG. 4, the papermaking mold 101, which is used as paired, has a papermaking block 102, a net 103 disposed on the surface of the papermaking block 102, and a frame 104. The papermaking block 102 has a block 120 which is rectangle in its plan view and a flange 121 which surrounds the block 120 from three sides. The frame 104 supports the papermaking block 102 from under the block 120 and the flange 121.

As shown in FIG. 5, the block 120 has a papermaking part 120*a* which is depressed in substantial conformity to a bottle container to be molded and a peripheral part 120*b* extending outward from the papermaking part 120*a* almost horizontally. The block 120 has a large number of interconnecting passages 120*c* which pierce the block 120 with their one end opening on the papermaking part 120*a*.

The flange 121 overhangs horizontally in three directions. In this embodiment, the upper side 121*a* of the overhanging flange 121 (this side will be sometimes referred to as a mating surface) is a surface on which a clamping force is exerted. The mating surface 121*a* has a groove 121*b* which depicts the shape of the letter "U" in its plan view. In this groove 121*b* is provided a sealing member 121*c* so that a pair of the papermaking molds 101 may be mated with tight seal. The sealing member 121*c* is preferably made of a material having corrosion resistance and heat resistance, such as silicone rubber, urethane rubber or fluororubber. The sectional shapes of the groove 121*b* and the sealing member 121*c* are not limited to those shown. Since the papermaking mold 101 is used as paired, it is preferred that either one of the paired molds have the groove 121*b* and the sealing member 121*c*.

In the papermaking mold 101 according to the present embodiment, the block 120 and the flange 121 are formed of a first member and a second member, respectively. The second member is fixed to the sides of the first member by a prescribed fixing means, such as screwing, welding, and the like. The block 120 and the flange 121 are preferably formed of a metal such as aluminum.

The net 103 is provided along the surface of the papermaking part 120*a* and the peripheral part 120*b*. The net 103 is shaped in conformity to the contour of a vertical half of a molded article to be produced. The part 103*a* of the net 103 that covers the peripheral part 120*b* (this part of the net 103 will hereinafter be referred to as a peripheral covering part) is disposed in a site where it does not directly receive a mold clamping force exerted in mold closure or is not damaged by the clamping force (including a case in which the net undergoes neither deformation nor damage by the mold clamping force and a case in which the mated nets are brought into contact with each other and slightly deformed in a mold clamped state but are not damaged). More specifically, the site of the peripheral part 120*b* where the peripheral covering part 103*a* is to be disposed is lower than the upper side 121*a* of the flange 121 by a certain level difference d, in this embodiment. In a mold clamped state, the level of the peripheral covering part 103*a* of the net 103 is lower than the mating surface 121*a*. The level difference d is decided appropriately according to the thickness of the peripheral covering part 103*a* of the net 103 laid along with the peripheral part 120*b* in a mold clamped state and the thickness of an auxiliary sealing member (or a mold clamping force buffering member) 130 hereinafter described. From the standpoint of preventing flash formation, the height from the upper surface of the peripheral covering part 103*a* of the net 103 (in cases where an auxiliary sealing member (or a mold clamping force buffering member) is provided on the upper side of the peripheral covering part 103*a* as in the present embodiment, the height from the surface with no such an auxiliary sealing member) to the upper side 121*a* of the flange is preferably in a range 0 to 5.0 mm, particularly 0 to 2.0 mm. When the height from the upper surface of the peripheral covering part to the height of the upper surface of the flange is 0 mm, the upper surface of the peripheral covering part of the net and the upper surface of the flange are even (the level difference d is equal to the thickness of the peripheral covering part of the net while along with the peripheral part 120*b* or, in the case of a knitted net, the thickness of the peripheral covering part with the knitted wires being along with the peripheral part 120*b*). In this case, although the peripheral covering parts of the two nets come into contact with each other in a mold clamped state, the clamping force is exerted on the upper surface of the flange but is not so directly exerted on the nets as to do damage to the nets. Therefore, in a mold clamped state, the peripheral covering parts of the nets can be brought into intimate contact without being collapsed. That is, the peripheral covering parts of the nets can be protected against damage while preventing the slurry from spewing therebetween. In this case, it is particularly preferred to provide the upper surface 121*a* of the flange 121 with the above-described sealing member 121*c* as in the present embodiment.

The peripheral part 103*b* of the net 103 is put into a gap 122 between the block 120 and the flange 121. A fixing plate 123 is disposed in the gap 122, which is pressed onto the side of the block 120 by a screw 124 through a threaded hole to fix the peripheral part 103*b* of the net 103. This manner of fixing the net 103 makes it easy to attach and detach the net 103, should the net undergo damage.

The net 103 is fabricated of metal or synthetic resin wire. The opening size is usually about 10 to 100 mesh (JIS L-0208). The net 103 may have a single layer structure, a knitted structure, or a composite structure composed of two or more net layers. A porous material having a large number of permeating pores which is formed by electroforming can be used as the net 103, in which case the diameter of the permeating pores is about 0.05 to 2 mm.

An auxiliary sealing member 130 having a prescribed width is provided integrally on the peripheral covering part 103*a* of the net 103. The auxiliary sealing member 130 is preferably provided on the upper surface of the peripheral covering part 103*a* of the net 103 with some thickness as a part integral with the net. So far as the sealing tightness in a mold clamped state is such that a slurry is prevented from oozing from between clamped molds in the papermaking step, the height of the upper side of the auxiliary sealing member 130 is not particularly limited, but is preferably larger than the height of the mating surface 121*a* in a state before the molds are closed. The auxiliary sealing member 130 also serves as a mold clamping force buffering member which buffers the clamping force exerted on the peripheral covering part 103*a* of the net 103 in a mold clamped state. The auxiliary sealing member (or clamping force buffering member) 130 is preferably made of anticorrosive and heat-resistant materials capable of elastic deformation, such as silicone rubber, urethane rubber, fluororubber, epoxy resins, etc. Even when the net 103 is deformed while a preform is pressed and dewatered in the step of papermaking and dewatering, the auxiliary sealing member made of such an elastically deformable material is capable of following the deformation while maintaining the tight fit as described later. The auxiliary sealing member 130 can be formed by heat press-bonding the material to the peripheral covering part 103*a* or coating or impregnating the peripheral covering part 103*a* with the material. Since the papermaking mold 101 is used as paired, it is preferred that either one of the paired molds have the auxiliary sealing member 130. While the auxiliary sealing member is a preferred member to be provided because of the above-mentioned effects, it may be omitted where only the contact of the peripheral covering parts of the mating nets in a mold clamped state (as described above, this contact is such that the mold clamping force is not so directly exerted on the nets as to damage the nets) provides sufficient tight seal for suppressing flash formation without the aid of the auxiliary sealing member.

It is preferred that the net 103 be disposed with a prescribed clearance over the papermaking part 120*a* for preventing clogging by pulp fibers during papermaking and for improving papermaking efficiency.

The frame 104 has a box shape with an open top. The upper side wall of the frame 104 has a recess 140 into which the block 120 of the papermaking block 102 is fitted. The left and the right sides of the frame 104 each have suction holes 142 which connect the inside and the outside of the frame 104. A sealing material 143 is provided on the top edge of the frame 104 so as to secure air- and liquid-tightness when the papermaking block 102 is fitted thereto.

The papermaking block 102 and the frame 104 are removably fixed to each other by fitting the papermaking block 102 into the frame 104 and fastening a ring 144 fixed to the side wall of the frame 104 to a hook 121*d* fixed to the flange 121 of the papermaking block 102. Seeing that the papermaking block 102 is removably fixed to the frame 104, a changeover in kind of articles to be molded can be made simply by exchanging papermaking blocks 102 because the shape of the papermaking part 120 of the papermaking block 102 varies according to the shape of a pulp molded article to be produced. It is not necessary to make a whole papermaking mold for every shape of products.

With the papermaking block 102 fitted into the frame 104, a hollow chamber 105 is formed therebetween. The hollow chamber 105 connects to the outside through the suction holes 142 and to the papermaking part 120*a* through the interconnecting passages 120*c* of the block 120.

As described hereunder, the papermaking mold 101 according to this embodiment is used as paired with another half A pair of the molds 101 are joined to mate the mating surfaces 121*a* thereby forming a cavity of prescribed shape, which is contoured by the two papermaking parts 120*a*. A pulp slurry is poured under pressure into the cavity to deposit pulp fiber on the net 103. Accordingly, while not shown, the pair to the papermaking mold 101 has the same structure.

Figure 6:
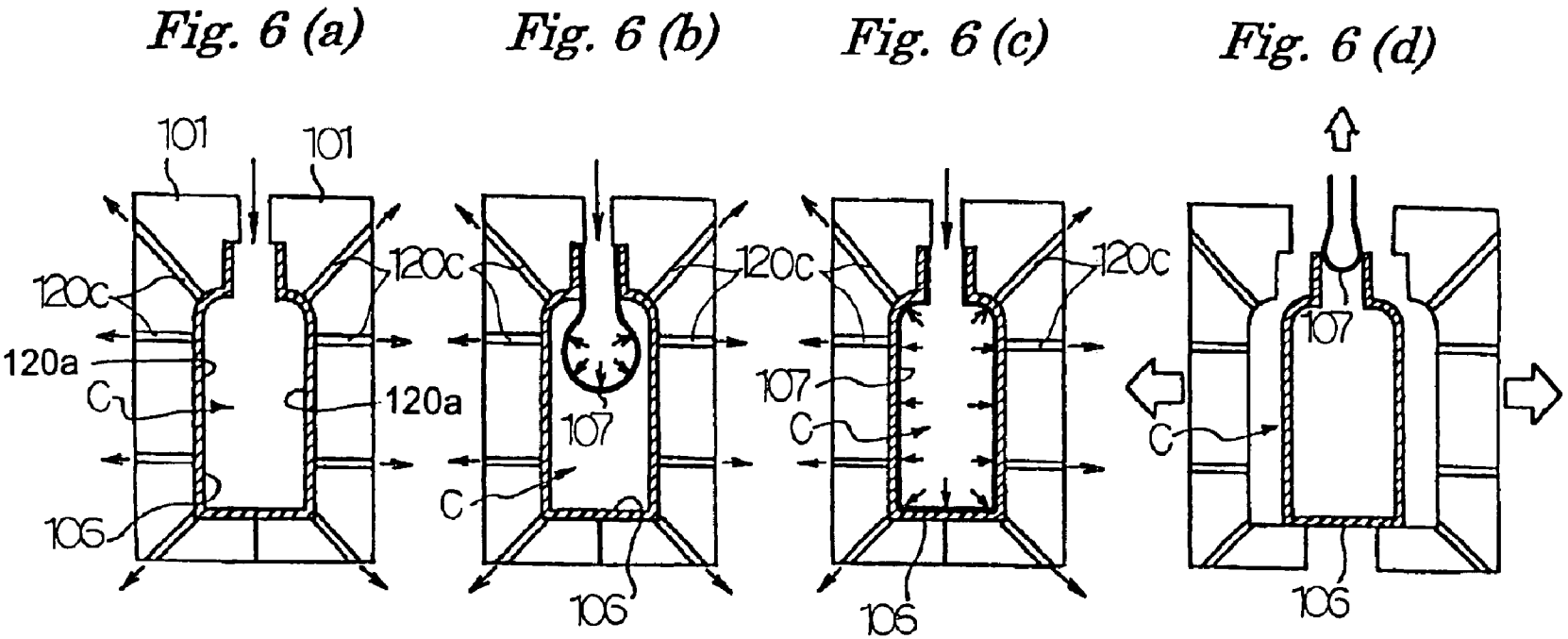
FIG. 6(*a*) schematically shows the step of injecting a pulp slurry followed by dewatering.

The papermaking mold 101 can be used, for example, in the method of producing a pulp molded article shown in FIGS. 6(*a*) through (*d*). As shown in FIG. 6(*a*), a pair of papermaking molds 101 and 101 are joined together with the papermaking parts 120*a* facing each other to mate the mating surfaces 121*a*. A cavity C of a prescribed shape is thus formed by the two papermaking parts 120*a*. A pulp slurry is injected into the cavity C through an opening connecting to the cavity C. In this state, the auxiliary sealing members 130 having an elastic force are in intimate contact with each other, but the mold clamping force is exerted on the mating surfaces 121*a* so that the nets 103 do not directly receive such a force as to damage the nets 103. As a result, the peripheral covering part of the net undergoes substantially no deformation and can be protected from damage in repeated papermaking operation.

The cavity C of the molds 101 and 101 is evacuated by sucking through the interconnecting passages 120*c*, whereby the water content of the pulp slurry is removed outside, and the pulp fiber is deposited on the net (not shown) to form a water-containing preform 106.

On completion of injecting a prescribed amount of the pulp slurry, injection is stopped, and the cavity C is completely sucked for dewatering through the interconnecting passages 120*c*. An inflatable hollow pressing member 107 is inserted into the cavity C while continuing sucking and evacuating the cavity C through the passages 120*c* as shown in FIG. 6(*b*). The pressing member 107 is made of an elastic material, such as urethane, fluororubber, silicone rubber or an elastomer, or a plastic material, such as polyethylene or polypropylene.

As shown in FIG. 6(*c*), a pressurizing fluid is fed into the pressing member 107 to inflate the pressing member 107. The inflated pressing member 107 presses the wet preform 106 onto the net. The preform 106 pressed to the net by the pressing member 107, pressing and dewatering of the preform 106 proceed while the inner shape of the cavity C is transferred to the preform 106. Even if the net is elastically deformed during this step, the auxiliary sealing member provided on the peripheral covering part of the net follows the deformation to secure the tight seal. Thus, the inner shape of the cavity C can be transferred without flash formation. The pressurizing fluid used to inflate the pressing member 107 includes compressed air (heated air), oil (heated oil), and other various liquids. The pressure for the pressurizing fluid feed is preferably 0.01 to 5 MPa, particularly 0.1 to 3 MPa.

After the preform 106 is pressed and dewatered to a prescribed water content, and after the inner shape of the cavity C is sufficiently transferred to the preform 106, the pressurizing fluid is withdrawn from the pressing member to shrink the pressing member as shown in FIG. 6(*d*). The shrunken pressing member is taken out of the cavity, and the molds are opened to remove the preform 106 having been dewatered to a prescribed water content. The removed preform 106 is subjected to a prescribed heat drying stage, where it is completely dried to give a pulp molded article.

With the papermaking mold 101 of the present embodiment, the peripheral covering part 103*a* of the net 103 is protected against direct contact with the mating surface of the complementary half in a mold clamped state. As a result, the peripheral covering part 103*a* of the net 103 hardly suffers damage from repeated mold opening and closure. The frequency of changing the damaged net for a new one is greatly reduced to considerably improve the working efficiency. Further, because the auxiliary sealing member 130 disposed on the peripheral covering part 103*a* of the net 103 secures tight seal, the slurry is prevented from oozing from between the mated peripheral covering parts 103*a* in the papermaking step. As a result, molded bottle articles having a satisfactory appearance with no substantial flashes on its outer surface can be obtained. Furthermore, since the net 103 is removably fixed, it is easy to attach and detach the net.

The present invention is not limited to the aforementioned embodiments. For example, the papermaking mold according to the present invention can have the configurations shown in FIGS. 7 to 11. In FIGS. 7 through 11, parts common to the papermaking mold 101 are given the same reference numerals, and the description thereof is omitted. Therefore, the explanation given to the papermaking mold 101 appropriately applies to the parts which are not specifically described hereunder.

Figure 7:
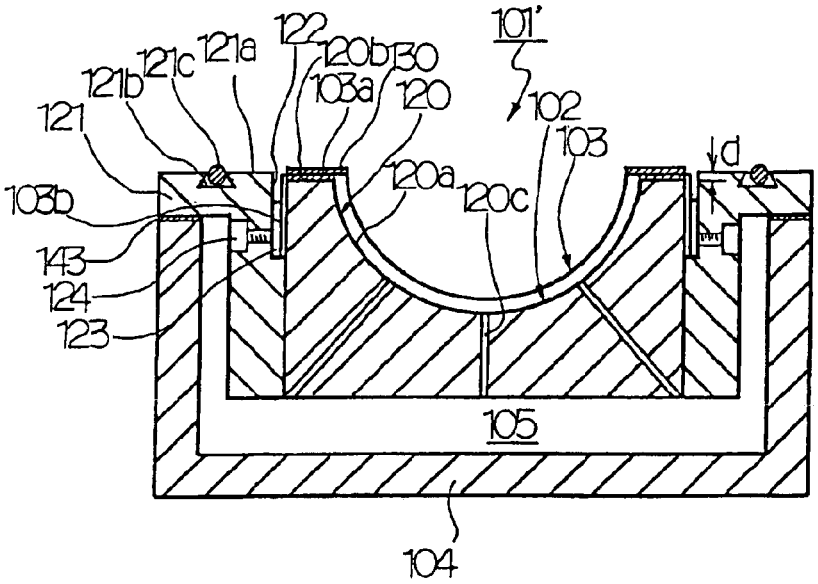
FIG. 7 schematically shows the cross-sectional structure of a papermaking mold according to another embodiment of the present invention which is used to produce a pulp molded article (equivalent to FIG. 5).

The papermaking mold 101' according to the embodiment shown in FIG. 7 has an auxiliary sealing member 130 on both the upper and the lower sides of the peripheral covering part 103*a* of the net 103 with some thickness as a part integral with the net. In this embodiment the damage to the net which may be caused by the friction between the peripheral part 120*b* and the peripheral covering part 103*a* of the net 103 can be suppressed as well.

Figure 8:
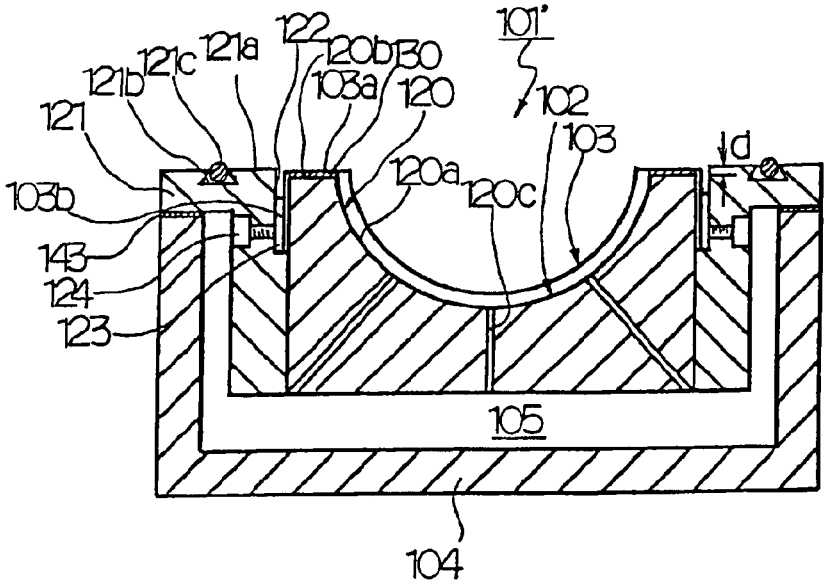
FIG. 8 schematically shows the cross-sectional structure of a papermaking mold according to another embodiment of the present invention which is used to produce a pulp molded article (equivalent to FIG. 5).

The papermaking mold 101' according to the embodiment shown in FIG. 8 has an auxiliary sealing member 130 on the lower side of the peripheral covering part 103*a* of the net 103 with some thickness as a part integral with the net, so that the mating peripheral covering parts 103*a* are brought into contact with each other without a sealing failure upon mold clamping. In this embodiment the nets come into direct contact with each other at their peripheral covering parts 103*a*, but because the auxiliary sealing member 130 functions as a mold clamping force buffering member, the shock of contact of the peripheral covering parts 103*a* can be relaxed. As a result, damage from direct contact between the peripheral covering parts 103*a* of the nets 103 and damage from friction between the peripheral covering part 103*a* of the net 103 and the peripheral part 120*b* of the block 120 can be suppressed.

Figure 9:
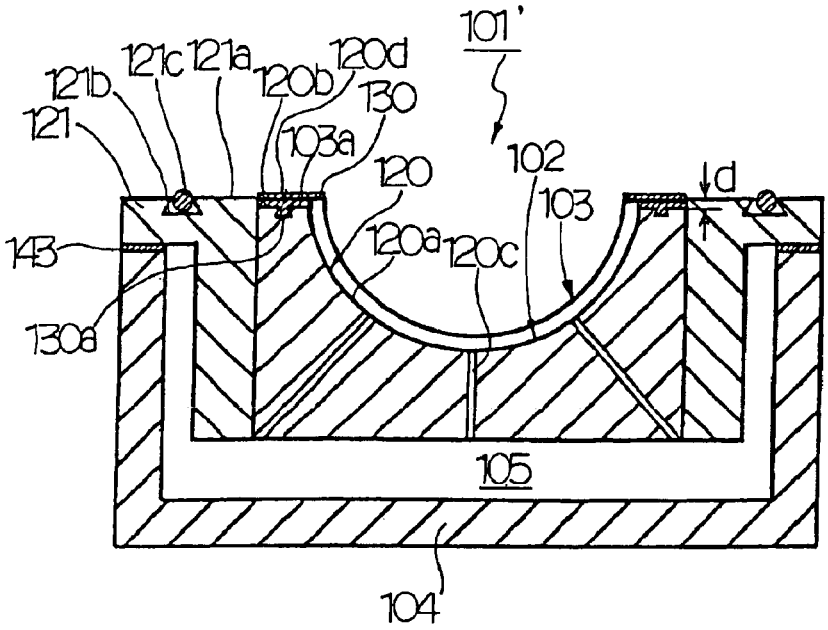
FIG. 9 schematically shows the cross-sectional structure of a papermaking mold according to another embodiment of the present invention which is used to produce a pulp molded article (equivalent to FIG. 5).

The papermaking mold 101' of the embodiment shown in FIG. 9 does not have a gap 122 as made in the papermaking mold 101. Instead, a groove 120*d* is formed on the surface of the peripheral part 120*b*, while the auxiliary sealing member 130 which is integral with the net 103 has a mating projection 130*a* which fits the groove 120*d* to fix the auxiliary sealing member 130 to the block 120. By this structure, the net 103 can be attached and detached more easily.

Figure 10:
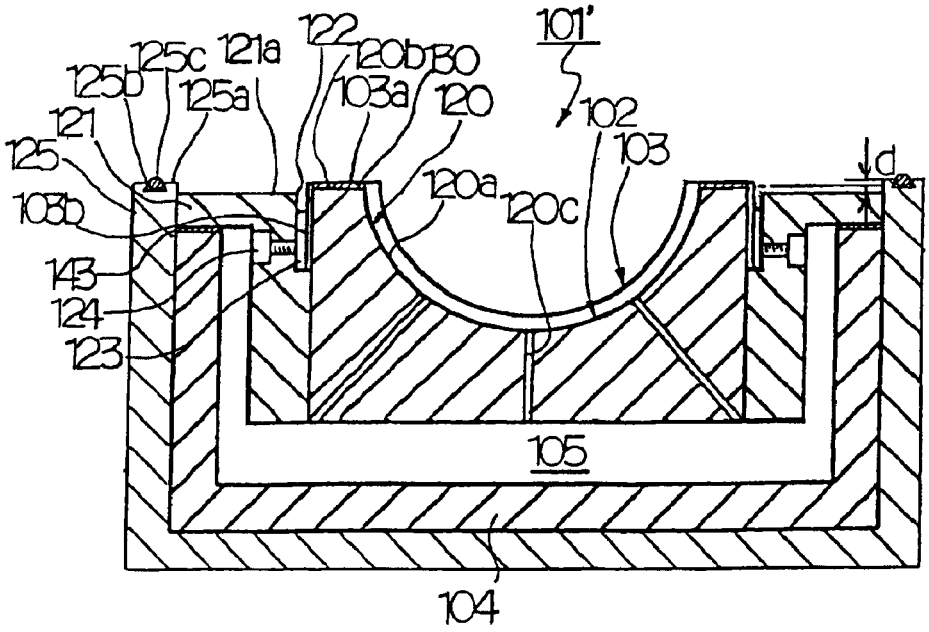
FIG. 10 schematically shows the cross-sectional structure of a papermaking mold according to still another embodiment of the present invention which is used to produce a pulp molded article (equivalent to FIG. 5).

In the papermaking mold 101' of the embodiment shown in FIG. 10, an alteration is made to the position where to dispose the sealing member on the surface to be mated on mold clamping so that the peripheral covering part 103*a* of the papermaking net 103 may be disposed such that it would not be deformed under the mold clamping force. That is, a mating member 125 is provided outside the frame 104. It is not the upper side 121*a* of the flange 121 but the upper edge side 125*a* of the mating member 125 that serves as a surface to be mated on mold clamping. The side 125*a* has a groove 125*b*, in which a sealing member 125*c* is fixedly fitted. The upper side 121*a* of the flange 121 is lower than the upper edge side 125*a* of the mating member 125. On mold clamping, two mating nets 103 come into contact at their peripheral covering parts 103*a*, while the clamping force is received by the mating upper edge sides 125*a*. As a result, the net 103 does not directly receive the clamping force. Further, since the shock of contact is relaxed by the auxiliary sealing member 130, damage from the friction between the mating nets 103 is also reduced.

Figure 11:
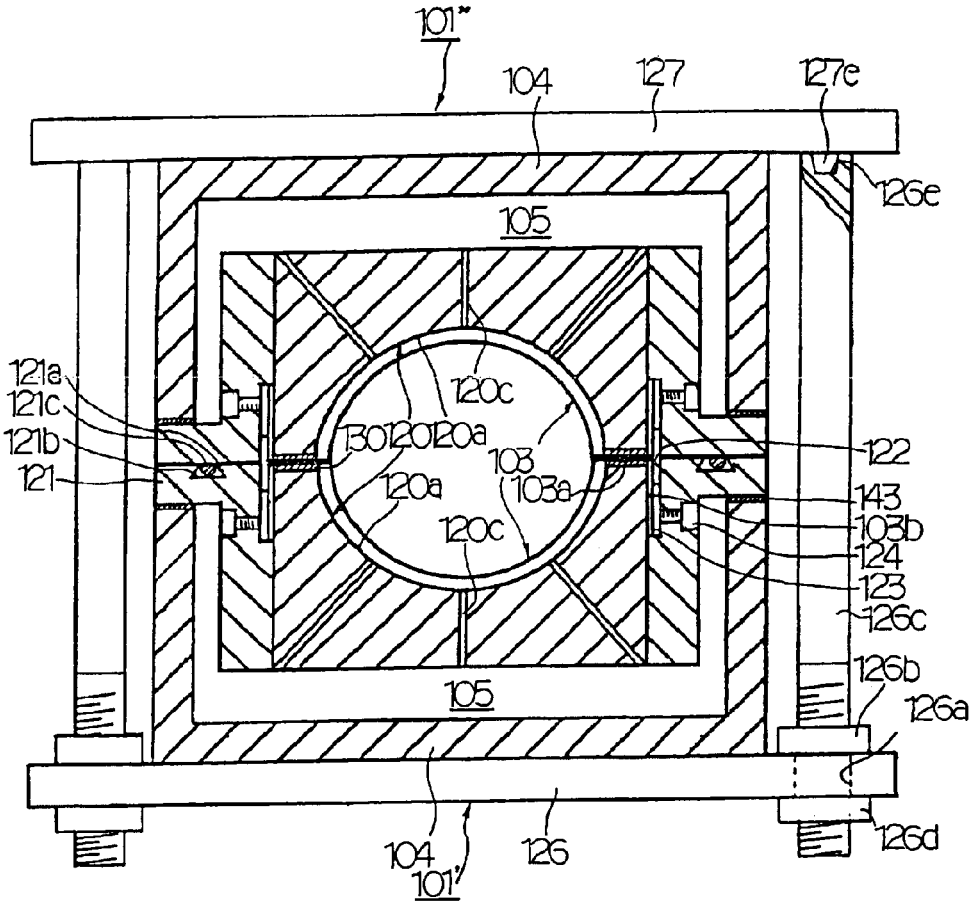
FIG. 11 is a schematic cross-sectional view of the main part of a papermaking mold in its clamped state according to yet another embodiment of the present invention, which is used for producing a pulp molded article.

The papermaking mold according to the embodiment shown in FIG. 11 is designed so that the peripheral covering part 103*b* of the papermaking net 103 may be disposed such that it would not be deformed under a mold clamping force and has a means for adjusting a mold clamping force. As for the papermaking mold 101' which is one of the paired papermaking molds (the lower one in FIG. 11), a plate 126 larger than the frame 104 is attached to the bottom (base) of the frame 104. The plate 126 has a plurality of through-holes 126*a* in at least the four corners. A nut 126*b* is put on the inner side of each of the through-holes. A bolt-like positioning member 126*c* which is male-threaded in conformity to the nut 126*b* is screwed in through the nut 126*b*, and a nut 126*d* is screwed tight on the positioning member 126*c* from the lower end of the positioning member 126*c*. The positioning member 126*c* has a depression 126*e* for positioning on its upper end surface (serving as a mating surface, on which a mold clamping force is exerted). The other papermaking mold 101" (the upper one in FIG. 11) has a plate 127 attached to the frame 104. The plate 127 has a projection 127*e* for positioning which fits the depression 126*e* for positioning. With this structure, even after the papermaking net 103 is fixed onto the block 120, the mold clamping force can be adjusted by the position of the positioning member 126*c* screwed in. That is, the means for adjusting a mold clamping force comprises the plates 126 and 127, the nuts. 126*b* and 126*d*, and the positioning members 126*c*. The positioning members 126*c* may be threaded over the whole length thereof With this structure, even after the papermaking net 103 is fixed, the molding clamping force can easily be adjusted so that the peripheral covering part 103*a* of the papermaking net 103 is not deformed and that the peripheral covering part 103*a* (or an auxiliary sealing member 130 if provided on the peripheral covering part 103*a*) may secure tight seal to provide a flash-free molded article. Having the depression 126*e* and the projection 127*e*, the structure makes it possible to carry out positioning with good accuracy in clamping the molds.

The present invention is not limited to the foregoing embodiments. For example, in the first embodiment wherein the fixing member 16 is fixed to the peripheral part 13 by the engagement of the mating projection and the mating depression, the fixing member 16 can be fixed to the peripheral part 13 by screwing, adhesion with a strippable adhesive, or a like means.

In the first embodiment, a mating depression may be formed on the second part of the fixing member 16, and a mating projection may be formed on the peripheral part 13.

Although it is preferred that the block 120 having the papermaking part 120*a* and the upper side of the flange 121, on which a mold clamping force is exerted, be formed of a first member and a second member, respectively, it is possible to form these parts integrally.

While it is preferred that the auxiliary sealing member be integral with the net and be disposed on the peripheral part 120*b* of the block 120, it may be fixed directly into a groove made on the peripheral part 120*b* of the block 120 or may be adhered to the peripheral part.

In the embodiment shown in FIG. 11, a depression and a projection for positioning are formed on the positioning member 126*c* and the facing plate 127, respectively. Unlike this, in cases where the upper side 121*a* of the flange 121 serves as a mating surface (a surface on which a mold clamping force is exerted), the depression and the projection for positioning may be formed on the mating positions of the upper side of the flanges.

The papermaking mold according to the present invention is also applicable to a press mold for papermaking which is composed of a male mold and a female mold.

INDUSTRIAL APPLICABILITY

The present invention provides a papermaking mold the net of which can be attached and detached with improved ease.

Where a fixing member is integrally fixed to the net, the net has increased strength and is prevented from deformation and the like when attached or detached.

The papermaking mold of the present invention is prevented from damaging the net thereof when used for papermaking repeatedly.

What is claimed is:

1. A papermaking mold, comprising:

a first papermaking part having a first prescribed shape;

a first fixing member;

a first net;

a second papermaking part having a second prescribed shape;

a second fixing member; and a second net, wherein the first net is attached to at least a portion of the first fixing member, the first fixing member is directly detachably attached to the first paper making part, such that the first net is free from a force applied to the first fixing member, the second net is attached to at least a portion of the second fixing member, and the second fixing member is directly detachably attached to the second papermaking part, and the first and second papermaking parts are configured to form a cavity into which pulp slurry is injected when the first and second papermaking parts are attached.

2. The papermaking mold of claim 1, further comprising a means for adjusting a mold clamping force.

3. A papermaking mold, comprising:

a first papermaking part having a first prescribed shape;

a first fixing member; and a first net, wherein the first net is attached to at least a portion of the first fixing member, and the first fixing member is directly detachably attached to the first paper making part, a second papermaking part having a second prescribed shape;

a second fixing member; and a second net, wherein the second net is attached to at least a portion of the second fixing member, the second fixing member is directly detachably attached to the second papermaking part, and the first and second papermaking parts are configured to form a cavity into which pulp slurry is injected when the fist and second papermaking parts are attached.

* * * * *